United States Patent [19]

Shigehiro et al.

[11] Patent Number: 4,935,784

[45] Date of Patent: Jun. 19, 1990

[54] DEVELOPING APPARATUS USING MICROCAPSULE DEVELOPING AGENT AND METHOD THEREOF

[75] Inventors: Kiyoshi Shigehiro; Kazuo Terao; Takashi Yamamuro, all of Kanagawa, Japan

[73] Assignee: Fuji Xerox Co., Ltd., Tokyo, Japan

[21] Appl. No.: 202,490

[22] Filed: Jun. 6, 1988

[30] Foreign Application Priority Data

Jun. 8, 1987 [JP] Japan ..... 62-141534

[51] Int. Cl.[5] ..... G03G 13/09; G03G 15/09

[52] U.S. Cl. ..... 355/253; 355/245; 430/122

[58] Field of Search ..... 355/245, 251, 253, 259; 118/657; 430/120, 122

[56] References Cited

U.S. PATENT DOCUMENTS 4,528,937 7/1985 Kanno et al. ..... 355/253 X
4,616,918 10/1986 Kohyama et al. ..... 355/259
4,662,311 5/1987 Shoji et al. ..... 118/658 X
4,755,847 7/1988 Matsushiro et al. ..... 355/259
4,760,422 7/1988 Seimiya et al. ..... 355/253
4,780,741 10/1988 Wada et al. ..... 355/253
4,799,086 1/1989 Mori ..... 355/251

*Primary Examiner*—Fred L. Braun
*Attorney, Agent, or Firm*—Finnegan, Henderson, Farabow, Garrett, and Dunner

[57] ABSTRACT

Apparatus for developing a latent image on a photo-sensitive drum which apparatus uses as a developing agent microcapsule toner magnetic particles wherein regulation member contacts the surface of developing agent carrier, or sleeve, under pressure for regulating the thickness of a uniform thin layer of the particles deposited on the sleeve and the contact pressure of the regulation member on the sleeve is not more than 20 g/cm. Preferably, the toner particles have a residual magnetic level not more than 4 emu/g and a magnetic holding force not more than 90 Oe.

7 Claims, 2 Drawing Sheets

DEVELOPING APPARATUS USING MICROCAPSULE DEVELOPING AGENT AND METHOD THEREOF

BACKGROUND OF THE INVENTION

The present invention relates to apparatus for the development of electrostatic latent images formed on a photo-sensitive drum, and more particularly, to such apparatus which uses a microcapsule developing agent.

A conventional electronic photo copying machine is shown in FIG. 1. A photo-conductive drum (electronic latent image carrier) 1 includes an aluminum substrate and a photo-conductive layer formed thereon. The surface of the drum 1 is uniformly electrostatically charged by an electrifying unit 23 prior to irradiation with a picture image. An original mount carriage 11 on which an original 13, e.g., a book to be copied, is mounted is disposed above the photo-conductive drum 1. Below the original mount carriage 11 there are disposed a light source 12 adapted to emit light against the surface 13 of the original to be copied and an optical system 14 adapted to direct light reflected from the original 13 toward the photoconductive drum 1.

An electro-static latent image is formed on the surface of the drum 1. This latent image is developed by use of a developing unit 15 disposed adjacent the surface of the drum 1 to develop an image, using a developing agent (or toner), on the drum's surface. This image is moved, by rotation of the drum, to an image transfer unit 16 at which location the toner image is transferred or copied onto a sheet 18 supplied from a sheet feed unit 17.

The sheet 18 carrying the transferred toner image is subjected to electron removal at an electrifying unit 19 and the sheet is peeled from the drum surface. The peeled sheet 18 is fed to an image fixing unit 20 where the toner image is fixed onto the sheet 18.

Residual toner on the surface of drum 1, which has not been transferred onto the sheet 18, is deelectronized by a precleaning corotron 21 after the transferring step, and then removed from the surface of the drum 1 by a cleaning unit 22. The cleaned surface is then in the stand-by state for a subsequent copying cycle.

The methods for fixing the toner image onto the sheet 18 are generally classified into a thermal-fixing method, a solvent fixing method, and a pressure fixing method.

The pressure fixing method has certain advantages in that with the use of this method the electric power consumption can be minimized, since a heat source, which is required in the thermal-fixing method, is not required. Further, the pressure fixing method requires only a short access time for initiating the copying, since it is unnecessary to wait for the temperature to be raised to a given temperature which is required in the thermal-fixing method.

The pressure fixing method conventionally uses a developing agent which contains wax as a primary component. However, such a developing agent does not provide sufficient fixing force relative to the paper. Therefore, there is a disadvantage that, if the paper is folded or rubbed, the picture image may be peeled from the sheet. In order to solve this drawback, a microcapsule developing agent has been proposed in which a core substance having an excellent image fixing property is confined in an outer shell which is rupturable under pressure to expose the core substance. While such a microcapsule developer particle has sufficient fixing capability its rupture strength is excessively low and, in fact, is much lower than that of a conventional developer agent particle, including ordinary compositions such as the combination of resin and carbon black.

Accordingly, if such microcapsule developer particles are used in a conventional two component developing system, which uses a toner and a carrier, the microcapsule particle is readily ruptured due to pressure contact with the carrier, and a stabilized image may not be obtainable.

Therefore, a single component microcapsule developing agent using only a magnetized toner comprising a magnetized powder has been proposed.

A conventional photo copying machine which uses a single component such magnetized toner as a developing agent is shown in FIG. 2. FIG. 2 shows a photo sensitive drum 1 adapted to carry the electro-static latent image 2 thereon which is positioned adjacent and opposite a developing unit D. The developing unit D includes a hopper 3 for containing a supply of single component magnetized toner 4, an agitator (not shown) for agitating and feeding the toner 4, a magnetic roll 5, a cylindrical non-magnetic sleeve 6, and a toner regulation member 7. The stationary magnetic roll 5 provides a plurality of magnetic poles N and S alternatingly arranged circumferentially around the roll 5. The sleeve 6 is rotatably supported and disposed over the magnetic roll 5. The regulation member 7 resiliently contacts the outer peripheral surface of the sleeve 6 and regulates the amount of the toner deposited onto the sleeve 6. The sleeve 6 and the regulation member 7 are disposed in an internal space of the hopper 3. Further, the sleeve 6 is disposed in the vicinity of the photo-sensitive drum 1 at the developing region A.

In the operation of such developing apparatus, a controlled amount of toner is deposited on the outer surface of sleeve 6 by the regulation member 7, and the single component magnetic toner 4 is held on the surface of the sleeve 6 by the magnetic force of the magnet roll 5,. Upon electrification, the toner 4 is fed, by the rotation of the sleeve 6, into the developing region A where the sleeve 6 and the drum 1 are opposite each other. Therefore, the sleeve 6 serves as a carrier member for carrying the toner. The sleeve 6 is connected to an alternating current source 8 and a direct current source 9, so that AC-DC superimposition voltage is applied to the sleeve 6. Toner adhered onto the sleeve 6 is electrostatically attracted to the electro-static latent image 2 formed on the surface of drum 1 when it rotates into the developing region A, whereupon it is developed for visualization.

The particles of the single component magnetizable toners 4 may become magnetically bunched up together, and form a soft mass, or compacted powder, during rotational movement of the toner together with the rotation of the sleeve 6. During repeated motion of the toner, the toner particles may become relaxed on the sleeve surface and are returned to the hopper 3 because of magnetic repulsion. Also, the particles are attracted to the sleeve surface by the magnetic force of the magnet. The soft powder mass or compacted powder may be transported through an area of contact between the regulation member 7 and the sleeve 6 whereupon the powder mass is subjected to pressure. In this case, if ordinary magnetizable toner consisting of resin and magnetic powder is used, the soft powder mass is ruptured because of the contact pressure between the sleeve 6 and the regulation member 7, so that the toner layer has a uniform thickness along the peripheral surface of the sleeve 6.

On the other hand, if a microcapsule toner is used in the device shown in FIG. 2, which is particularly adapted for the use of a single component developing agent, the capsules may be ruptured by the contact pressure, due to the low strength of the capsule. Therefore, the core substance may flow out of the capsule, so that the core substance may adhere to adjoining particles and thereby create a rigid powder mass that degrades the uniformity in thickness of the toner layer on the sleeve 6.

SUMMARY OF THE INVENTION

It is, therefore, an object of the invention to overcome the above-mentioned drawbacks and to provide an improved developing apparatus capable of using a microcapsule developing agent which does not rupture the microcapsules or form solid compacts regardless of operation of the device over a long period of time.

Briefly, the present invention overcomes problems attributed to the employment of microcapsule developing agent in a single component developing apparatus by (a) minimizing the magnetic force required to transfer the microcapsule developing agent onto a drum so as to minimize magnetic concentration, and (b) providing optimum contact pressure of a regulation member with respect to the developing agent carrier (sleeve) so as to prevent rupture of the microcapsules when the microcapsules pass through the space between the regulation member and the sleeve to form a thin layer of microcapsules on the sleeve.

The present invention employs microcapsule developing agent particles that include a core-substance and an outer shell containing magnetizable powders. The microcapsule developing agent developing apparatus includes an electro-static latent image carrier member, a developing agent carrier member adjacent to and opposite the image carrier member, a hopper member for containing the developing agent, and a regulation member contacting the agent carrier member under a pressure sufficient to regulate the thickness of the layer of developing agent on the surface of the agent carrier member so as to provide a uniformly thin layer, but not great enough to rupture the microcapsule developing agent particles. The pressure exerted against the surface of the developing agent carrier member is not more than 20 g/cm.

BRIEF DESCRIPTION OF THE DRAWINGS

In the accompanying drawings.

It should be noted that the developing apparatus shown in FIG. 2 may be modified for use in accordance with the present invention by using the developing agent and/or the regulation member of the present invention, both as hereinafter described, instead of a conventional toner component and regulation member.

DETAILED DESCRIPTION

Figure 3:
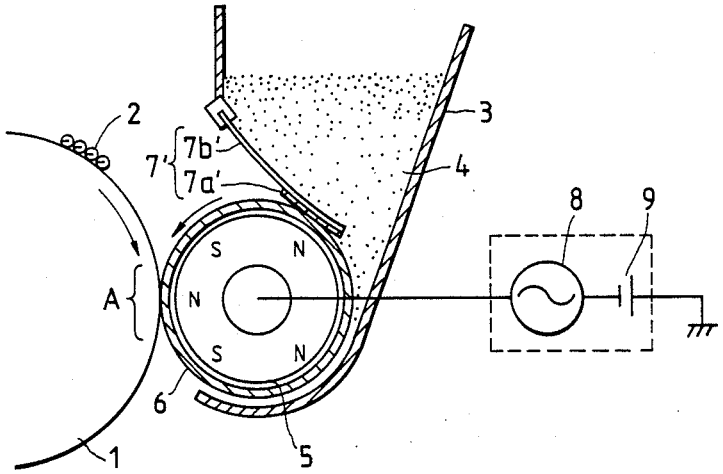
FIG. 3 is a schematic cross-sectional view showing a developing apparatus according to one embodiment of the preseent invention.

In accordance with the present invention, a microcapsule type developing agent has residual magnetic level of not more than 4.0 emμ/g, and magnetic holding force of not more than 90 Oe. Further, as shown in FIG. 3, a regulation member for controlling the thickness of the layer of the developing agent on the surface of the developing agent carrier body is urged against the surface of the carrier body under a contact pressure of not more than 20 g/cm. The "contact pressure" at which the regulation member is urged against the developing agent carrier implies a line pressure of a load per a unit length. That is, the regulation member 7' includes an elongated resilient supporting member 7b', acting as a leaf spring, supported at one end by a wall of a hopper 3 and a soft elastic member 7a', acting as a pressure pad, provided at the free end thereof in pressure contact with the surface of a sleeve 6 (developing agent carrier) along its length.

The magnetic characteristic of the microcapsule developing agent is measured at an externally applied magnetic field of 10 KOe by a vibromotive magnetic tester (not shown). The residual magnetic value of the conventional single component magnetic developer agent is generally in a range of from 5 to 20 emμ/g, and has a magnetic holding force of from 100 to 200 Oe. If the microcapsule particle has a magnetic force the same as that of the conventional magnetizable toner, magnetic concentration of the particles and rupture of the concentrated mass may occur. On the other hand, in the present invention formation of magnetically concentrated mass which leads to rupture of particles, is restrained by controlling the magnetic force and/or amount of the magnetic material which is contained in the microcapsule particles, which consist of a core substance and an outer shell. The magnetic toner material of this invention has a residual magnetic value and a magnetic holding force smaller than that of the conventional magnetic toner, i.e. a residual magnetic value of not more than 4 emμ/g, and magnetic holding force of not more than 90 Oe, in the present invention.

The microcapsule developing agent particles employed in the present invention can be manufactured by various conventional methods for producing microcapsules. For example, interfacial polymerization, in situ polymerization, coating by hardening in liquid, phase separation, drying in liquid, cooling by dissolution and dispersion, floating suspension spray drying, or other known methods may be employed in producing the microcapsule particles.

Magnetic material, or magnetizable material, contained in the microcapsule particles may be a metal selected from the group consisting of: cobalt, iron, nickel; magnetic metal alloys, metal oxides and various mixtures of aluminum, cobalt, copper, iron, lead, magnesium, nickel, zince, antimony, beryllium, vanadium, manganese, and zirconium; and highly magnetic ferrite and mixtures thereof with other materials.

The magnetic force required in the microcapsule developing agent is obtained by controlling the magnetic force of these magnetic materials themselves. Further, the magnetic force is also controllable by controlling the ratio of these materials to the developing agent.

In the conventional developing agent regulation member, the supporting member has a thickness of 0.1 to 0.5 mm and is formed of SUS steel (as a leaf spring material), and the soft elastic member provided at the free end portion of the supporting member is made of silicone rubber. In this conventional construction, the regulation member has a contact pressure of 100 to 300 g/cm with respect to the sleeve (or developing agent carrier) 6. However, if the microcapsule developing agent is used in such apparatus, the pressure is excessive, so that the outer shell of the microcapsule may be easily ruptured when it passes between the regulation member and the sleeve.

In accordance with the present invention, the contact pressure of the regulation member with respect to the developing agent carrier should not be more than 20 g/cm, and preferably not more than 10 g/cm.

A conventional metallic spring material, such as SUS steel, does not permit stably maintaining such a relatively small contact pressure over a prolonged period of time. Therefore, in accordance with the present invention, the supporting member *7b'* is formed of a plastic film such as, for example, polyester film, polyimide film, or nylon film, and the elastic member *7a'* is formed of soft rubber.

If the regulation member 7' provides a contact pressure of not more than 20 g/cm and a conventional single component developing agent is used, the transfer amount of the agent transferred to the sleeve 6 tends to become too large, so that a uniformly thin layer may not be obtainable on the sleeve 6. Therefore, a contact pressure of not more than 20 g/cm is employed when using the microcapsule developing agent according to the present invention.

Figure 1:
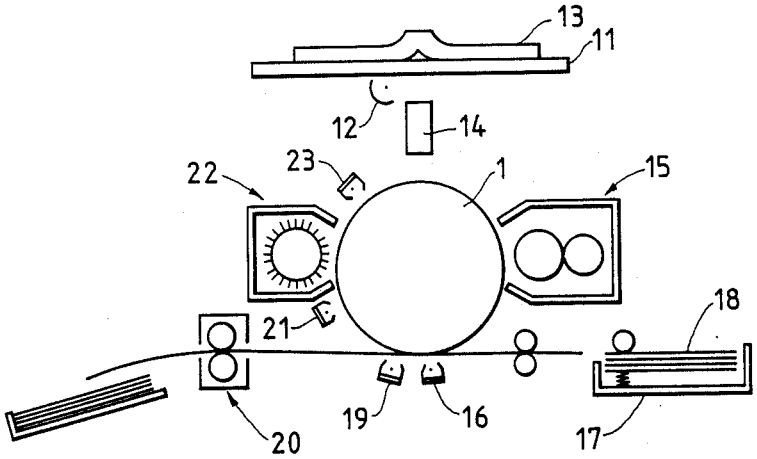
FIG. 1 PRIOR ART
FIG. 1 is a schematic view showing a conventional electronic photocopying machine.
Figure 2:
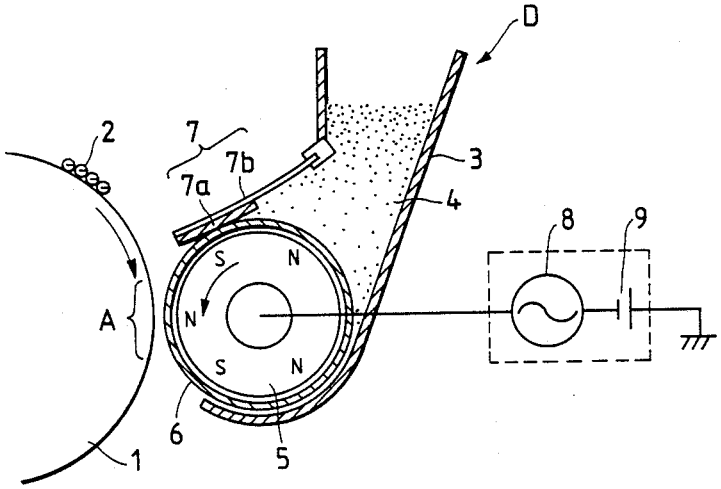
FIG. 2 PRIOR ART
FIG. 2 is a schematic cross-sectional view showing a developing apparatus use in a conventional electronic photocopying machine.
Figure 4:
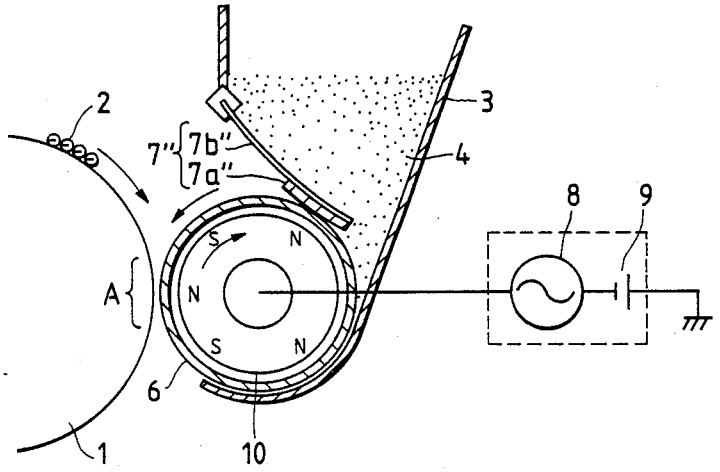
FIG. 4 is a schematic cross-sectional view showing a developing apparatus according to an modified embodiment of this invention.

When using the microcapsule developing agent of this invention, the conventional type apparatus shown in FIG. 2 may be used with modification in accordance with the present invention; however, apparatus such as those shown in FIGS. 3 and 4 may also be used. In the apparatus shown in FIG. 3, the one end of a developing agent regulation member 7' is supported from a wall of the hopper 3 which extends in the direction of the longitudinal axis of the sleeve 6 and the opposite free end thereof extends inwardly toward the interior of the hopper 3 in the direction of the opposite wall of the hopper. The remaining components of the apparatus are the same as those shown in FIG. 2. With the structure shown in FIG. 3, the pressure applied to the microcapsule developing agent entering into the space between the regulation member 7' and the sleeve 6 would be smaller than that applied in the FIG. 2 device due to the weight of the capsules. Therefore, both formation of powder mass and rupture of the capsules are further restrained.

In another embodiment of the invention shown in FIG. 4, a magnetic roll 10 is rotated in a direction opposite to the rotational direction of the sleeve 6. Otherwise, the apparatus is the same as that of the structure shown in FIG. 3. Relative rotation between the sleeve 6 and the magnetic roll 10 is required. Therefore, a stationary sleeve 6 and a rotating magnetic roll 10, rotatable with respect to the stationary sleeve 6 may also be used.

EXAMPLE 1

Microcapsule particles were produced by the interfacial polymerizing method. The microcapsule included 45 wt % of magnetite particles having a residual magnetic level of 6.1 emμ/g and magnetic holding force of 75 Oe. Magnetic characteristics of the microcapsule particles were measured at an externally applied magnetic field of 10 KOe, the microcapsule particles had residual magnetic level of 2.8 emμ/g and magnetic holding force of 80 Oe. The microcapsule particles were placed, as a developing agent, in a hopper of developing apparatus of the type shown in FIG. 2, and a thin uniform layer of the developing agent was obtained on the sleeve.

The developer agent regulation member used herein had a support member *7b'*, formed of polyester (Trade Name: MYLAR/product of Du Pont, Ltd.), having a thickness or 100 μm, and a silicone rubber member *7a'* having a thickness of 1 mm was provided at the free end of the support member. The contact pressure of member *7a'* against the surfaces of the developing agent carrier 6 was 2 g/cm. about 1.6 mg/cm$^2$ of toner adhered onto the sleeve 6. For developing, an alternating current having a frequency of 2.0 HKZ, peak voltage of 2000 V, and DC component of −200 V was applied. With such conditions, excellent copying quality was obtained.

Also, an unfixed copying sheet was subjected to image fixing at a pressure of 180 kg/cm$^2$. As a result, sufficient image fixing was obtained in a resultant copying image. Toner on the sleeve 6 was collected to investigate toner concentration. The toner particles after use were still independent of one another, without any sticking together, and were similar to the toner particles before use. A thin uniform layer of the developing agent was obtained even after continuous operation of the developing apparatus for three hours.

EXAMPLE 2

Microcapsule particles were produced by the in situ polymerization method. The microcapsules included 40 wt % of magnetite particles having a residual magnetic level of 4.2 emμ/g, and a magnetic holding force of 54 Oe. Magnetic characteristics of the microcapsule particles were measured at externally applied magnetic field of 10 KOe. The capsules had a residual magnetic level of 1.7 emμ/g and magnetic holding force of 58 Oe. The microcapsule particles were placed as a developing agent in a hopper of developing apparatus of the type shown in FIG. 3, and a uniformly thin developing layer of toner was obtained on the sleeve. The regulation member was the same as that used in EXAMPLE 1, and the member was urged against the sleeve 6 at contact pressure of 5 g/cm. The amount of toner adhered onto the sleeve 6 was 1.5 mg/cm$^2$. Developing was then carried out in a condition the same as that of EXAMPLE 1. As a result, excellent copy images were obtainable, and sufficient image fixing was made after pressure fixing treatment. Toner on the sleeve 6 was collected to investigate toner concentration. The toner particles after use were still independent of one another, without sticking together and were similar to the toner particles before use. A thin uniform layer of the developing agent was provided even after continuous operation of the developing agent apparatus for three hours.

COMPARATIVE EXAMPLE 1

Microcapsule particles were produced by the interfacial polymerization method. The microcapsules included 40 wt % of magnetite particles having a residual magnetic level of 10.8 emμ/g, and a magnetic holding force of 135 oe. Magnetic characteristics of the microcapsule particles were measured at an externally applied magnetic field of 10 Koe. The capsule had a residual magnetic level of 4.7 emμ/g and a magnetic holding force of 140 oe. The microcapsule particles were placed, as developing agent, in a hopper of a developing apparatus of the type shown in FIG. 3, and a toner layer having uniform thin thickness was obtained. Upon developing, excellent copy images were obtained, and upon fixing, a sufficiently fixed image was obtained. However, upon investigation of the toner concentration, part of the toner particles were stuck together, contrary to the independent particles before use. Upon continuous operation of the developing apparatus for 10 minutes, linear grooves were formed on the toner layer. A mass of toner particles was adhered to the sleeve part positioned below the regulation member 7.

COMPARATIVE EXAMPLE 2

The microcapsule particles obtained in EXAMPLE 1 were accumulated in a hopper of the apparatus shown in FIG. 2, and a uniform thin toner layer was obtained. A regulation member included a support member formed of SUS steel having a thickness of 0.2 mm, and a silicone rubber member fixed to the support member. The regulation member was disposed to provide a contact pressure of 150 g/cm against the surface of the developing agent carrier, and 1.42 mg/cm$^2$ of toner was adhered to the sleeve 6. Then, for the developing, an alternating current having a frequency of 2.4 kHz, peak voltage of 2400 V, and DC component of −200 V was applied. With these conditions, a first copy image and its image fixed quality were sufficient; however, when photocopying the second sheet, grooves were formed in the toner layer, and toner mass was adhered to the sleeve portion below the regulation member 7.

EXAMPLE 3

Microcapsule particles obtained in EXAMPLE 1 were accumulated in a hopper of a developing apparatus of the type shown in FIG. 4 to provide a uniform thin toner layer. In the apparatus shown in FIG. 4, the magnetic roll 10 was not stationary, but was rotatable. The sleeve 6 was rotated in a direction opposite the rotational direction of a photo-sensitive drum 1 at a peripheral speed, 2.5 times as high as that of the drum. The magnetic roll 10 was rotated to a direction opposite to the rotational direction of the sleeve 6 at a peripheral speed 8 times as high as that of the sleeve 6. The regulation member 7″ was the same as that used in EXAMPLE 1, and a contact pressure of 5 g/cm was provided by the regulation member 7″ against the surface of the developing agent carrier. As a result, the amount of toner adhered onto the sleeve 6 was 1.5 mg/cm$^2$. Thereafter, alternating voltage was applied in the same manner as that in EXAMPLE 1. With the condition, excellent copying quality was obtained, and sufficient image fixed was obtained. Further, similar to EXAMPLE 1, toner concentration on the sleeve 6 did not occur, and a uniformly thin layer was obtained after continuous developing operation for 3 hours.

In view of the foregoing, it is seen that there is distinct improvement in the operation of the single component developing apparatus in which there is provided a regulation member that regulates the amount of toner adhered onto the developing agent carrier, the contact pressure of the regulation member against the surface of the developing agent carrier is not more than 20 g/cm, and there is used a microcapsule developing agent having residual magnetic level of not more than 4.0 emμ/g, and magnetic holding force of not more than 90 oe.

According to the present invention, magnetic concentration of the microcapsule developing agent and rupture of the microcapsules can be restrained, because of the prevention of powder mass from occurring. Further, rupture of the microcapsules does not occur even after use over a prolonged period of time, since the contacting pressure of the regulation member is reduced to a low level. Therefore, a highly reliable apparatus results.

Having described preferred embodiments of the present invention, it is recognized that modifications and variations thereof will occur to those skilled in the art, and it is intended that the scope of the present invention is to be limited only to the appended claims and their equivalents.

We claim:

1. Apparatus for developing a latent image on an electrostatic latent image carrier adopted to carry an electrostatic image, wherein microcapsules designed for pressure image fixing are used as a development agent, said microcapsules having a core substance and an outer shell in which magnetizable powders are contained, said apparatus comprising:

a developing agent carrier disposed adjacent to and opposite the latent image carrier including a rotatable magnetic roll member on the interior of said developing agent carrier and wherein said developing agent carrier is rotatable and wherein said developing agent carrier and said magnetic roll are each rotated in a direction opposite to the other;

a hopper member for containing the developing agent; and a regulation means contacting the surface of said developing agent carrier under pressure of not significantly more than 20 g/cm for allowing the developing agent to pass from said hopper onto said developing agent carrier and for regulating the thickness of a uniform thin layer of the developing agent formed on a surface of said developing agent carrier body wherein said microcapsules have a residual magnetic level of not more than 4 emμ/g and a magnetic holding force of not more than 90 Oe.

2. The apparatus of claim 1, wherein said regulation means comprises:

a support member formed of polyester resin plate and having a free end; and an elastic member fixed to the free end of said support member and contacting the surface of said developing agent carrier.

3. The apparatus of claim 1, wherein said regulation means provides a contact pressure of not more than 20 g/cm on the surface of said developing agent carrier.

4. The apparatus of claim 3, wherein said regulation means provides a contact pressure of not more than 10 g/cm on the surface of said developing agent carrier.

5. Apparatus for developing a latent image on an electrostatic latent image carrier adopted to carry an electrostatic image, wherein microcapsules designed for pressure image fixing are used as a development agent, said microcapsules having a core substance and an outer shell in which magnetizable powders are contained, said apparatus comprises:

a developing agent carrier disposed adjacent to and opposite the latent image carrier including a rotatable magnetic roll member on the interior of said developing agent carrier and wherein said developing agent carrier is rotatable and wherein said developing agent carrier and said magnetic roll are each rotated in a direction opposite to the other;

hopper member for containing the developing agent; and a support member formed of polyester resin plate and having a free end supported from a wall of said hopper member and extending from said wall inwardly toward the interior of said hopper member, wherein said support member contacts the surface of said developing agent carrier under pressure of not significantly more than 20 g/cm for allowing the developing agent to pass from said hopper onto said developing agent carrier and for regulating the thickness of a uniform thin layer of the developing agent formed on a surface of said developing agent carrier body wherein said mircocapsules have a residual magnetic level of not more than 4 emμ/g and a magnetic holding force of not more than 90 Oe.

6. The method of transferring a toner having magnetized microcapsules having a residual magnetic level of not more than 4 emμ/g and a magnetic holding force not greater than 90 Oe to a latent image carrier, said method comprising:

disposing the magnetized microcapsules adjacent to a development agent carrier;

rotating the development agent carrier in a selected direction;

simultaneously rotating a magnetic roll disposed inside the development agent carrier in a direction opposite of the development agent carrier;

regulating the thickness of the toner adjacent to the latent image carrier by pressing a regulation member against the developing agent carrier with a pressure of not significantly more than 20 g/cm.

7. The method of claim 6 wherein the step of regulating is done by pressing the regulation member against the development agent carrier with a pressure of not more than 10 g/cm.

* * * * *